US009765598B2

(12) United States Patent
Bennett

(10) Patent No.: US 9,765,598 B2
(45) Date of Patent: Sep. 19, 2017

(54) EXPANSION SYSTEM

(71) Applicant: ENVENTURE GLOBAL TECHNOLOGY, INC., Houston, TX (US)

(72) Inventor: Frederick Cornell Bennett, Houston, TX (US)

(73) Assignee: Enventure Global Technology, Inc., Houston, TX (US)

( * ) Notice: Subject to any disclaimer, the term of this patent is extended or adjusted under 35 U.S.C. 154(b) by 219 days.

(21) Appl. No.: 14/704,229

(22) Filed: May 5, 2015

(65) Prior Publication Data

US 2015/0315882 A1 Nov. 5, 2015

Related U.S. Application Data

(60) Provisional application No. 61/988,740, filed on May 5, 2014.

(51) Int. Cl.
*E21B 43/10* (2006.01)

(52) U.S. Cl.
CPC ..... *E21B 43/103* (2013.01); *E21B 43/105* (2013.01); *E21B 43/108* (2013.01)

(58) Field of Classification Search
CPC ..... E21B 43/103; E21B 43/105; E21B 43/108
See application file for complete search history.

(56) References Cited

U.S. PATENT DOCUMENTS 7,028,770 B2 * 4/2006 Smith, Jr. ..... E21B 43/105 166/206
7,117,941 B1 10/2006 Gano et al.
2004/0244968 A1 * 12/2004 Cook ..... A47B 43/00 166/242.6
2007/0209806 A1 9/2007 Mock
2008/0190616 A1 8/2008 Watson
2009/0308594 A1 * 12/2009 Lohbeck ..... E21B 29/10 166/207
2013/0299184 A1 * 11/2013 Ali ..... E21B 34/14 166/373

FOREIGN PATENT DOCUMENTS

EP 2599952 * 5/2013 ..... E21B 23/04
EP 2599952 6/2013

OTHER PUBLICATIONS

International Search Report and Written Opinion issued Jul. 31, 2015 for corresponding WO Application No. PCT/US2015/029203. (9 pages).

* cited by examiner

*Primary Examiner* — Yong-Suk (Philip) Ro
(74) *Attorney, Agent, or Firm* — Derek V. Forinash; Porter Hedges LLP

(57) ABSTRACT

A method of expanding a tubular member by assembling an expansion system having an expansion cone and an expansion sleeve and coupling a tubular member to the expansion system so that the expansion sleeve is at least partially disposed within the tubular member. The expansion system and tubular member are then disposed in a wellbore and the expansion cone is translated relative to the expansion sleeve and tubular member so as to radially expand the tubular member into engagement with the wellbore and the expansion system is removed from the wellbore. The tubular member is expanded to an inside diameter equal to an expansion diameter of the expansion cone plus twice a thickness of the expansion sleeve.

13 Claims, 5 Drawing Sheets

EXPANSION SYSTEM

CROSS-REFERENCE TO RELATED APPLICATIONS

This application claims the benefit under 35 U.S.C. §119 (e) of U.S. Provisional Patent Application No. 61/988,740 filed May 5, 2014, the disclosure of which is hereby incorporated herein by reference for all purposes.

BACKGROUND

This disclosure relates generally to methods and apparatus for expanding wellbore tubular members, such as casing. More specifically, this disclosure relates to methods and apparatus for expanding a section of casing to an inside diameter that allows a second expandable tubular and expansion system to pass through the previously expanded section and then expanded to the same inside diameter.

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial force, the tubular member plastically deforms, thereby permanently increasing both its inner and outer diameters. In other words, the tubular member expands radially. Expandable tubulars may also be used to repair, seal, or remediate existing casing that has been perforated, parted, corroded, or otherwise damaged since installation.

In certain application, it may be desirable to install a series of expanded tubular sections having the same inside diameter. Many prior art expansion systems are sized so that the maximum diameter of the expansion system in a running configuration is too large to pass through a previously expanded tubular section and a smaller diameter system had to be used.

Thus, there is a continuing need in the art for methods and apparatus for expansion systems and methods that overcome these and other limitations of the prior art.

BRIEF SUMMARY OF THE DISCLOSURE

A method of expanding a tubular member by assembling an expansion system having an expansion cone and an expansion sleeve and coupling a tubular member to the expansion system so that the expansion sleeve is at least partially disposed within the tubular member. The expansion system and tubular member are then disposed in a wellbore and the expansion cone is translated relative to the expansion sleeve and tubular member so as to radially expand the tubular member into engagement with the wellbore and the expansion system is removed from the wellbore. The tubular member is expanded to an inside diameter equal to an expansion diameter of the expansion cone plus twice a thickness of the expansion sleeve.

An expansion system comprises a housing having a bore and an expansion piston disposed within the bore. An expansion cone is coupled to the expansion piston and has an expansion diameter. An expansion sleeve is coupled to the housing and has an inside diameter less than the expansion diameter of the expansion cone. A weakening feature is formed in the expansion sleeve. An expandable tubular disposed on a portion of the expansion sleeve.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
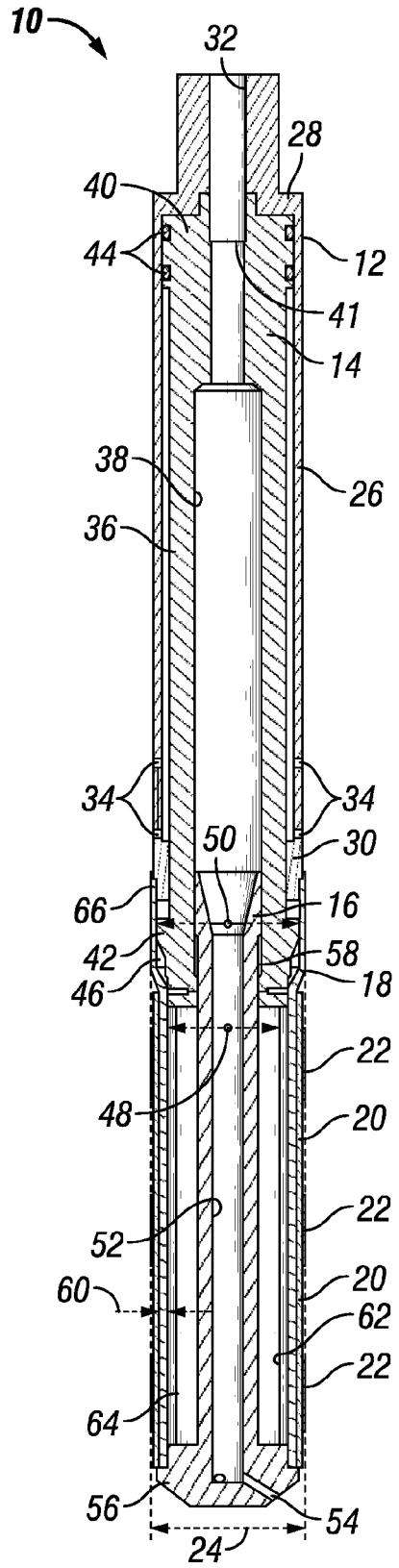
FIG. 1 is a cross-sectional view of an expansion system in a running configuration.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 3:
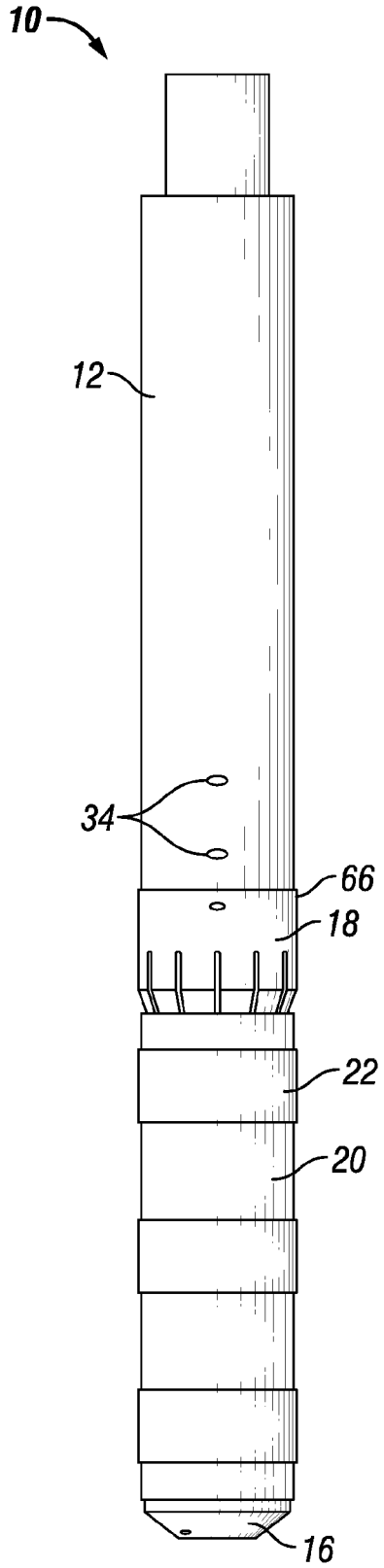
FIG. 3 is an elevation view of the expansion system of FIG. 2 with an expandable tubular installed.

Referring initially to FIG. 1, an expansion system 10 includes a housing 12, an expansion piston 14, a mandrel 16, and an expansion sleeve 18. Configured in a running position, as shown in FIGS. 1 and 3, an expandable tubular 20 is disposed over a portion of the expansion sleeve 18. The exterior of the expandable tubular 20 may be fitted with sealing members 22 that form a seal between the expandable tubular 20 and the surrounding wellbore when the expandable tubular 20 is expanded. The expansion system 10 has a gauge diameter 24 that is defined by the largest outside diameter of system which may be maximum outside diameter of (i) the housing 12, (ii) the sealing members 22, (iii) the expandable tubular 20 if not equipped with sealing members 22, or (iv) the expansion sleeve 18.

The housing 12 includes a housing wall 26 having an upper end 28 and a lower end 30. The upper end 28 is configured to be coupled to a drill string (not shown) or to some other support member, such as tubing or wireline, as well as provide fluid communication with a supply of hydraulic fluid through housing inlet 32. The housing wall 26 includes fluid ports 34 that provide fluid communication across the housing wall 26.

The expansion piston 14 is disposed within the housing 12 and includes an elongate body 36 having a bore 38, a piston end 40, and an expansion cone 42. The piston end 40 may include a ball seat 41 and one or more sealing members 44 that sealingly engage the housing wall 26. The expansion cone 42 includes a profiled surface 46 having an initial diameter 48 and an expansion diameter 50. The mandrel 16 is partially disposed within the bore 38 of the housing 12. The mandrel 16 includes a flowbore 52, outlet port 54, retainer flange 56, and an upper shoulder 58.

Figure 2:
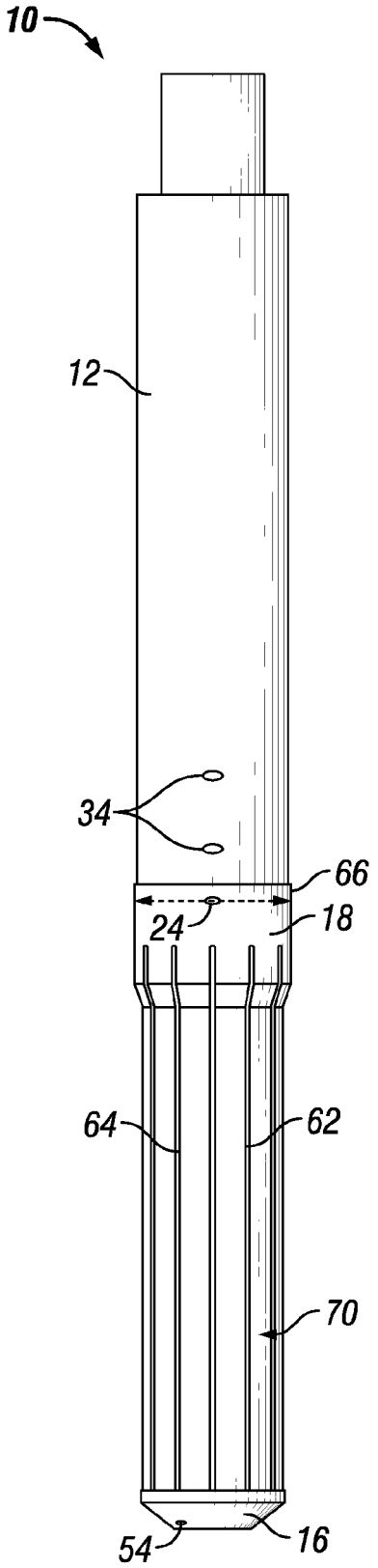
FIG. 2 is an elevation view of an expansion system without an expandable tubular installed.

The expansion sleeve 18 is a tubular member having a wall thickness 60. The expansion sleeve 18 is sized and configured to have a minimum resistance to radial expansion, or minimum hoop strength. As the wall thickness 60 of the expansion sleeve 18 is determined by the geometrical limitations of the expansion system 10, the hoop strength of the expansion sleeve 18 can be reduced by forming one or more weakening features 62 in the wall of the expansion sleeve. In the embodiment illustrated in FIGS. 2 and 3, the weakening features 62 include a plurality of longitudinal slots 64 that extend along a substantial length of the expansion sleeve 18. In other embodiments, the weakening features may include perforations, grooves, holes, cut outs, or other slot configurations.

The expansion sleeve 18 has an upper end 66 that is coupled to the lower end 30 of the housing 12. The upper end 66 of the expansion sleeve 18 is formed with an inside diameter that accommodates the expansion diameter 50 of the expansion cone 42. The upper end 66 of the expansion sleeve 18 has an outside diameter that may be equal to or slightly smaller than the gauge diameter 24 of the expansion system 10. The expansion sleeve 18 has a weakened portion that includes the weakening features 62 and fits inside the expandable tubular 20 and has an inside diameter sized to engage the initial diameter 48 of the expansion cone 42.

As will be described in detail to follow, as the expansion system 10 operates, the expandable tubular member 20 is expanded to an inside diameter, or drift diameter, that is substantially equal to the expansion diameter 50 of the expansion cone 42 plus two times the wall thickness 60 of the expansion sleeve 18. The expansion diameter 50 and the wall thickness 60 may be selected so that the expanded inside diameter, or drift diameter, of the expandable tubular member 20 is greater than the gauge diameter 24 of the expansion system 10. With this configuration, an expansion system 10 can pass through, and be expanded below, an expandable tubular member 20 that has previously been installed in a wellbore.

Figure 4:
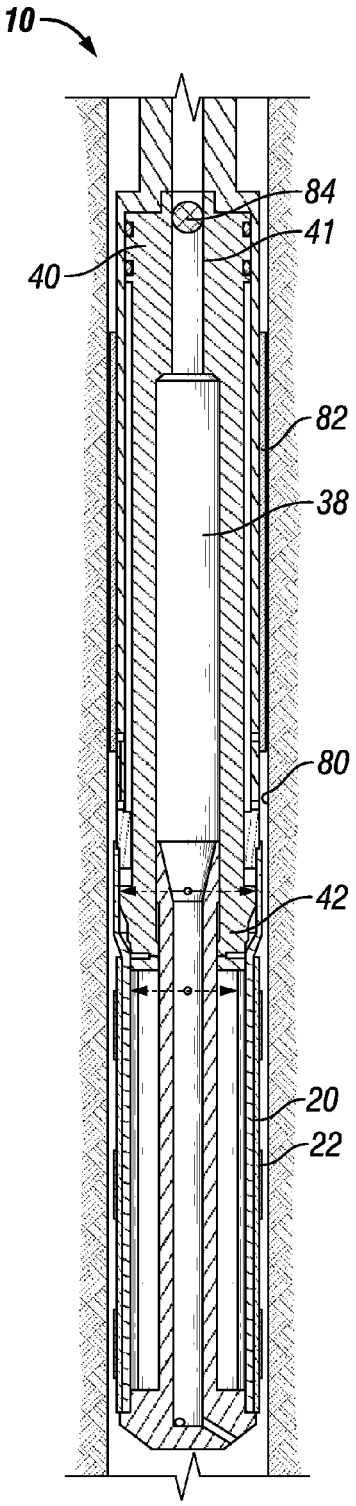
FIGS. 4-7 are partial sectional views of an expansion system installing an expandable tubular in a wellbore.
Figure 6:
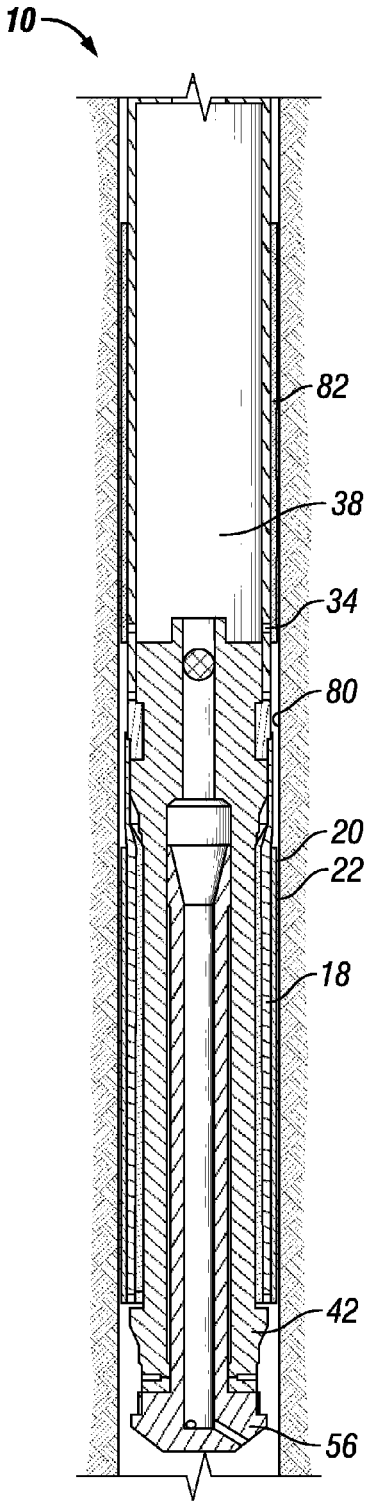

Referring now to FIG. 4, once the expansion system 10 is assembled, as shown in FIG. 3, it can be run into a wellbore 80 on drill pipe (not shown). In certain installations, the wellbore 80 may already include a casing section 82 that the expansion system 10 can pass through. Once the expansion system 10 is located at a desired location within wellbore 80, a ball 84 is dropped from the surface and sealingly engages the ball seat 41 of the expansion piston 14. The engagement of the ball 84 and ball seat 41 prevents fluid flow through the bore 38.

Once the ball 84 is engaged with the ball seat 41, continued supply of pressurized fluid to the expansion system 10 will create a pressure differential across piston end 40 of the expansion piston 14. This pressure differential generates an axial force on the expansion piston 14, which will move the expansion cone 42 axially through the expansion sleeve 18 and expandable tubular member 20.

Figure 5:
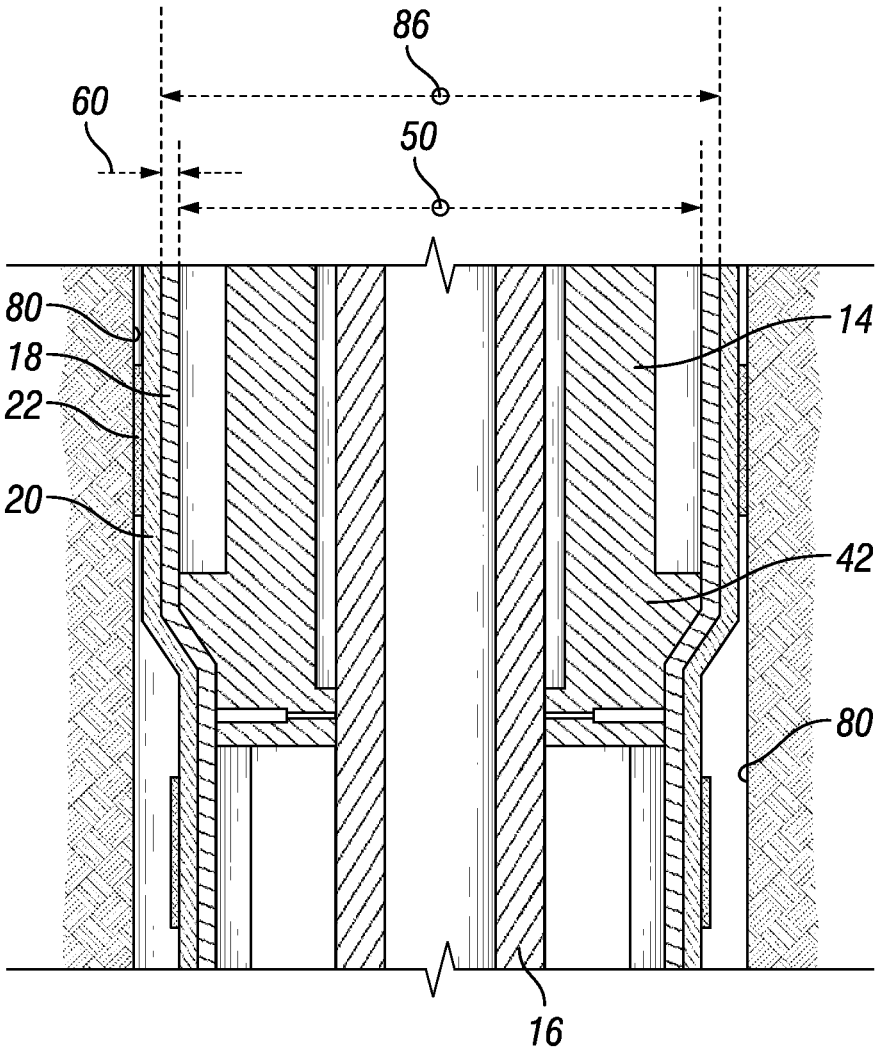
Figure 8:
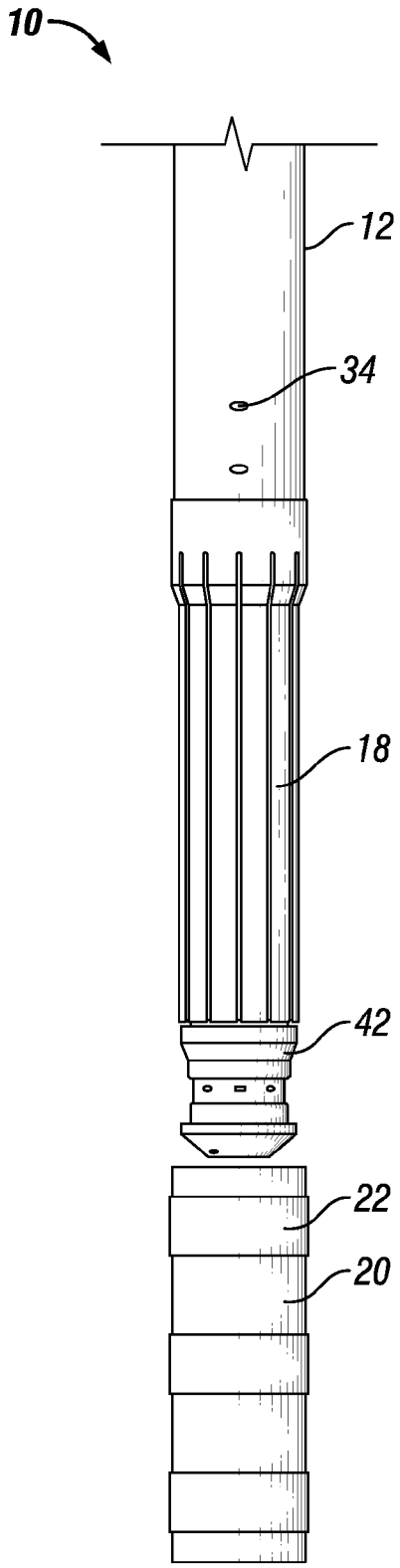
FIG. 8 is a partial sectional view of an expansion system being pulled from an installed expandable tubular.

As shown in FIG. 5, as the expansion cone 42 passes axially through the expansion sleeve 18 and the expandable tubular member 20, the expandable tubular member 20 is expanded to an inside diameter 86. The inside diameter 86 is equal to the expansion diameter 50 of the expansion cone 42 plus twice the thickness 60 of the expansion sleeve 18. As the expandable tubular member 20 is expanded, the sealing members 22 are compressed between the expandable tubular member 20 and the surrounding wellbore 80.

The expansion piston 14 will continue to move through the housing 12 until the expansion cone 42 passes fully through the expansion sleeve 18. At this point, fluid ports 34 will allow fluid to exit the bore 38 and equalize the differential pressure acting on the expansion piston 14. Once the expansion piston 14 has reached this position, the expansion cone 42 has passed fully through the expansion sleeve 18 and the expandable tubular member 20 is coupled to the surrounding wellbore 80 by the compression of the sealing members 22 between the tubular member 20 and the surrounding wellbore 80.

Figure 7:
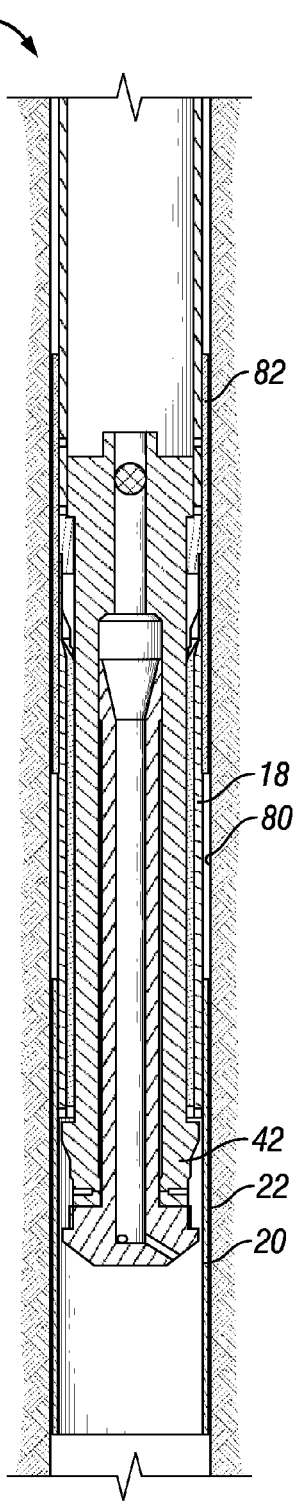

Referring now to FIGS. 7 and 9, once the tubular member 20 has been fully expanded, the expansion system 10 can then be pulled upward. As the expansion system 10 is pulled upward, the expansion sleeve 18 will deflect inward as necessary, thus allowing the expansion system 10 to be removed from the tubular member 20 and pass through a previously expanded casing section 82 if necessary. Another expansion system 10 with an unexpanded expansion sleeve 18 and tubular member 20 can then be run into the wellbore 80 and installed at a lower location in the wellbore.

Although the figures show expansion system 10 being operated as a top-down system, in certain embodiments the system can be operated as a bottom-up system. In these embodiments, the expansion cone will initially be positioned at the lower end of the expansion sleeve and expandable tubular member. Similar to the illustrated embodiment, internal pressure will push the expansion cone upward through the expansion sleeve and expandable tubular member and then the cone and sleeve can be retrieved from the wellbore.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. An expansion system comprising:

a housing;

an expansion piston partially disposed within the housing, wherein the expansion piston has a piston end sealingly engaged with the housing and an expansion cone having an expansion diameter;

a mandrel having a first end partially disposed within a bore through the expansion piston and a second end having a retainer flange;

an expansion sleeve disposed about the mandrel, wherein the expansion sleeve has an upper end coupled to the housing and a lower end in contact with the retainer flange; wherein the expansion piston is configured so that the expansion cone is moveable from the upper end of the expansion sleeve through the lower end of the expansion sleeve;

a weakening feature formed in the expansion sleeve; and an expandable tubular disposed over a portion of the expansion sleeve so that as the expansion cone moves through the expansion sleeve, the expandable tubular is radially expanded.

2. The expansion system of claim 1, wherein the weakening feature comprises one or more longitudinal slots.

3. The expansion system of claim 1, further comprising a ball seat disposed within the bore of the expansion piston.

4. The expansion system of claim 1, further comprising one or more fluid ports formed through a wall of the housing.

5. The expansion system of claim 1, wherein a gauge diameter of the expansion system is less than expansion diameter plus twice a thickness of expansion sleeve.

6. The expansion system of claim 1, wherein a flowbore through the mandrel is in fluid communication with the bore through the expansion piston.

7. The expansion system of claim 1, further comprising a seal disposed on an outer surface of the expandable tubular.

8. A method of expanding a tubular member comprising:

assembling an expansion system having an expansion piston with a piston end sealingly engaged with the housing and an expansion cone having an expansion diameter, a mandrel having a first end partially disposed within a bore through the expansion piston and a second end having a retainer flange, and an expansion sleeve disposed about the mandrel and having an inside diameter less than the expansion diameter of the expansion cone, wherein the expansion sleeve has an upper end coupled to the housing and a lower end in contact with the retainer flange;

coupling a tubular member to the expansion system so that the expansion sleeve is at least partially disposed within the tubular member;

disposing the expansion system and tubular member in a wellbore;

translating the expansion cone fully through the expansion sleeve and tubular member so as to radially expand the tubular member into engagement with the wellbore, wherein the tubular member is expanded to an inside diameter equal to an expansion diameter of the expansion cone plus twice a thickness of the expansion sleeve; and removing the expansion system from the wellbore.

9. The method of claim 8, further comprising pumping fluid through the expansion system as the expansion system is being disposed in the wellbore.

10. The method of claim 8, further comprising disposing a ball in sealing engagement with the expansion cone.

11. The method of claim 8, wherein the expansion sleeve includes one or more weakening feature.

12. The method of claim 8, further comprising retrieving the expansion system from the wellbore after the tubular member is expanded, wherein the tubular member remains in the wellbore after the expansion system is retrieved.

13. The method of claim 8, wherein the tubular member is expanded to an inner diameter that is larger than a gauge diameter of the expansion system.

* * * * *